US008607986B2

(12) United States Patent
Lipinski

(10) Patent No.: US 8,607,986 B2
(45) Date of Patent: Dec. 17, 2013

(54) WRAPAROUND PACKAGING SLEEVE WITH STAND-UP FEATURE

(75) Inventor: Jeffrey Matthew Lipinski, Waunakee, WI (US)

(73) Assignee: Kraft Foods Group Brands LLC, Northfield, IL (US)

( * ) Notice: Subject to any disclaimer, the term of this patent is extended or adjusted under 35 U.S.C. 154(b) by 123 days.

(21) Appl. No.: 13/234,815

(22) Filed: Sep. 16, 2011

(65) Prior Publication Data

US 2013/0068653 A1 Mar. 21, 2013

(51) Int. Cl.
*B65D 5/50* (2006.01)

(52) U.S. Cl.
USPC ..... 206/762; 206/764

(58) Field of Classification Search
USPC ..... 206/764, 762, 434, 541, 548; 229/103.2, 902, 57.08, 87.08
See application file for complete search history.

(56) References Cited

U.S. PATENT DOCUMENTS 3,443,681 A * 5/1969 Wysocki ..... 206/508
4,221,320 A 9/1980 Faller
4,962,849 A 10/1990 Anderson
5,011,006 A 4/1991 Anderson
5,123,527 A 6/1992 Hustad
5,657,873 A 8/1997 Hustad et al.
5,657,874 A 8/1997 Hustad et al.
5,743,402 A * 4/1998 Gics ..... 206/459.5
5,888,565 A * 3/1999 Gics ..... 426/124
5,900,263 A * 5/1999 Gics ..... 426/87
5,958,484 A 9/1999 Gics
6,092,664 A * 7/2000 Bartosek ..... 206/784
6,261,616 B1 * 7/2001 Simpson et al. ..... 426/119
6,394,337 B1 * 5/2002 Ross et al. ..... 229/103.2
7,281,630 B2 10/2007 Hartman et al.
2007/0187264 A1 8/2007 Hofte et al.

FOREIGN PATENT DOCUMENTS

GB 2127677 4/1984

* cited by examiner

*Primary Examiner* — David Fidei
(74) *Attorney, Agent, or Firm* — Fitch, Even, Tabin & Flannery LLP

(57) ABSTRACT

A wraparound sleeve having a stand-up feature or tab is disclosed. The sleeve can be wrapped around a container and can cooperate with a front flange portion of the container to provide the container in an upright display position. The tab of the sleeve extends from an exposed edge of the sleeve transverse to a wrapping direction of the sleeve when assembled to support the package in a vertical or inclined viewing position.

3 Claims, 1 Drawing Sheet

WRAPAROUND PACKAGING SLEEVE WITH STAND-UP FEATURE

FIELD

This disclosure relates generally to wraparound sleeves with a stand-up feature and, in particular, to a wraparound sleeve wrapped around a package.

BACKGROUND

Prior packaging systems are known that include sleeves or other wraparound type collars with a support tab, see U.S. Pat. No. 6,092,664 to Bartosek. The '664 patent discloses a collar or sleeve that wraps around a tray with the collar ends overlapping at a joint, where they are connected, with an end extending from the joint to form a tab that extends in the wrapping direction of the collar. The tab then acts with the corresponding edge of the tray and collar portion covering the edge of the tray to support the package in an upright position. However, in assembling the collar care must be taken upon interconnecting the overlapping portions at the joint, such that the tab is properly formed extending beyond the joint. Thus, there is a high precision required in assembling the collar portion/sleeve to ensure that the tab is properly formed so that an adequate amount of the overlapping portion extends from the joint to form the tab.

It is also known to provide sleeves having an end flap in addition to a support leg with the end flap being mechanically secured to the tray in order to retain the tray within the sleeve and to almost completely enclose the tray therein, as disclosed in U.S. Pat. No. 5,958,484 to Gics. The '484 patent discloses a sleeve that envelops or covers almost the entire tray and that in addition to a tab extending from a joint overlapping at an end of the sleeve in the wrapping direction of the sleeve, the sleeve also has at least one end flap extending from the sleeve along an adjacent edge perpendicular to the leg that is mechanically secured to the tray to retain the tray within the sleeve. These end flaps extend from the back panel of the sleeve and contain bend or fold lines therebetween to allow the end flaps to be movable with respect to the back panel. The end flaps fold inwards along the bend lines toward the opposite end of the tray packaged within the sleeve to secure to the flange of the tray, essentially enclosing the entire tray within the sleeve. Thus, if a translucent or transparent tray is provided, its interior contents would not be visible to a consumer because of the sleeve that is wrapped around it.

Accordingly, there is a need for a sleeve that can provide a stand up feature to stand a package upright without completely enclosing the package therein and further does not require precision in assembling the sleeve such that a tab would need to extend precisely in relation to the overlapping panels of the sleeve when assembling.

SUMMARY

In accordance with the present invention a sleeve with a stand-up support tab is provided that wraps around a container to display the container in a relatively vertical or upright position. The support tab extends transverse to the wrapping direction of the sleeve when assembled and cooperates with a front flange portion of the container contained therein to stand the package in an upright position.

The sleeve is wrapped around a mid-portion of a package without completely covering all ends or side walls of the package. This provides for the package contained therein to be partially viewed through at least an upper surface such that the contents stored therein can be partially visible when the container is transparent or translucent. This also provides for the ends of the package to be exposed such that the exposed flange portion can cooperate with the support tab to support the package in an upright position upon a support surface. Thus, the tab extends beyond the sleeve and beyond an end wall of the package such that it is relatively parallel to the front flange portion of the container that also extends beyond the sleeve, providing two complimentary surfaces that can both contact the support surface to support the package upright. The tab does not need to cooperate with another portion of the sleeve in order to support the container upright.

The tab extension of the present invention is already formed in the sleeve prior to assembly at an exposed edge of the sleeve. Upon assembling the sleeve, the panel portions can be assembled and adhered together without requiring additional precision and coordination of both the forming/adhering step of the sleeve and of ensuring that an adequate excess portion of the panel extends beyond the interconnecting part of the sleeve to form the tab. This provides for a simple assembly process of the sleeve where the tab does not have to be formed while assembling the sleeve. Furthermore, a simple manufacturing process can be used which allows the blanks for the sleeve to be run on existing sleeve application equipment with minimal changes or modifications to the equipment currently in use.

Additionally, the tab extension is free-standing such that it is sturdy on its own without additional material of the sleeve folded around it. The tab extension from the sleeve, in cooperation with the front flange portion of the container, can provide a more stable food package when displayed on a shelf or in a refrigerator, for instance. In addition, the tab in cooperation with the front flange portion can provide a more vertical viewing angle for the consumer. Furthermore, the viewing angle can be varied by varying the length of the tab, varying the display position between a relatively vertical orientation to a specified angle that is less than 90 degrees from a front viewing position.

DETAILED DESCRIPTION

Figure 1:
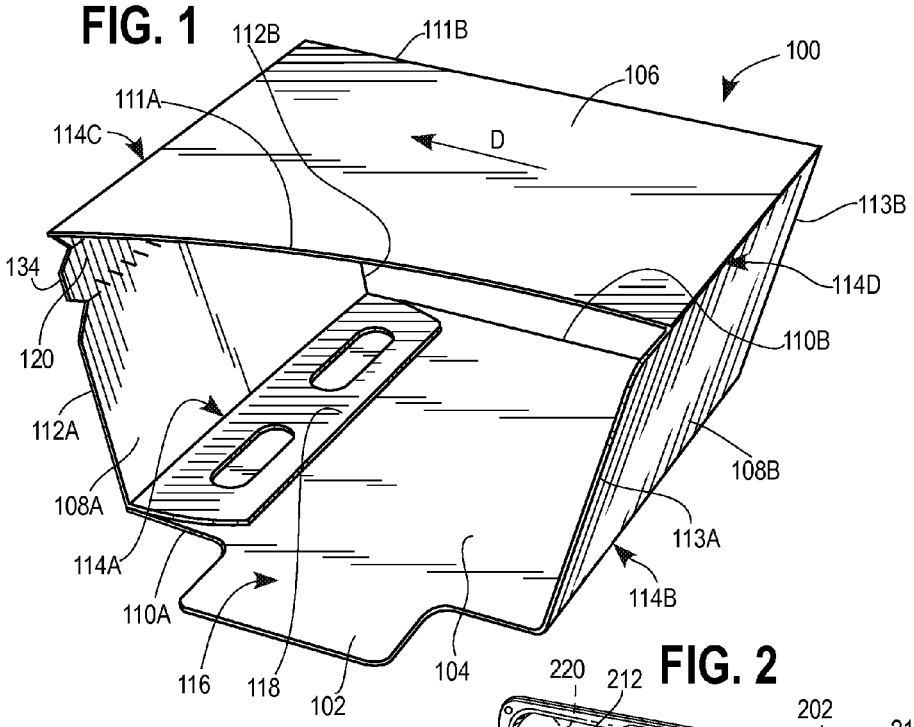
FIG. 1 is a perspective view of a wraparound sleeve with a stand-up feature.
Figure 2:
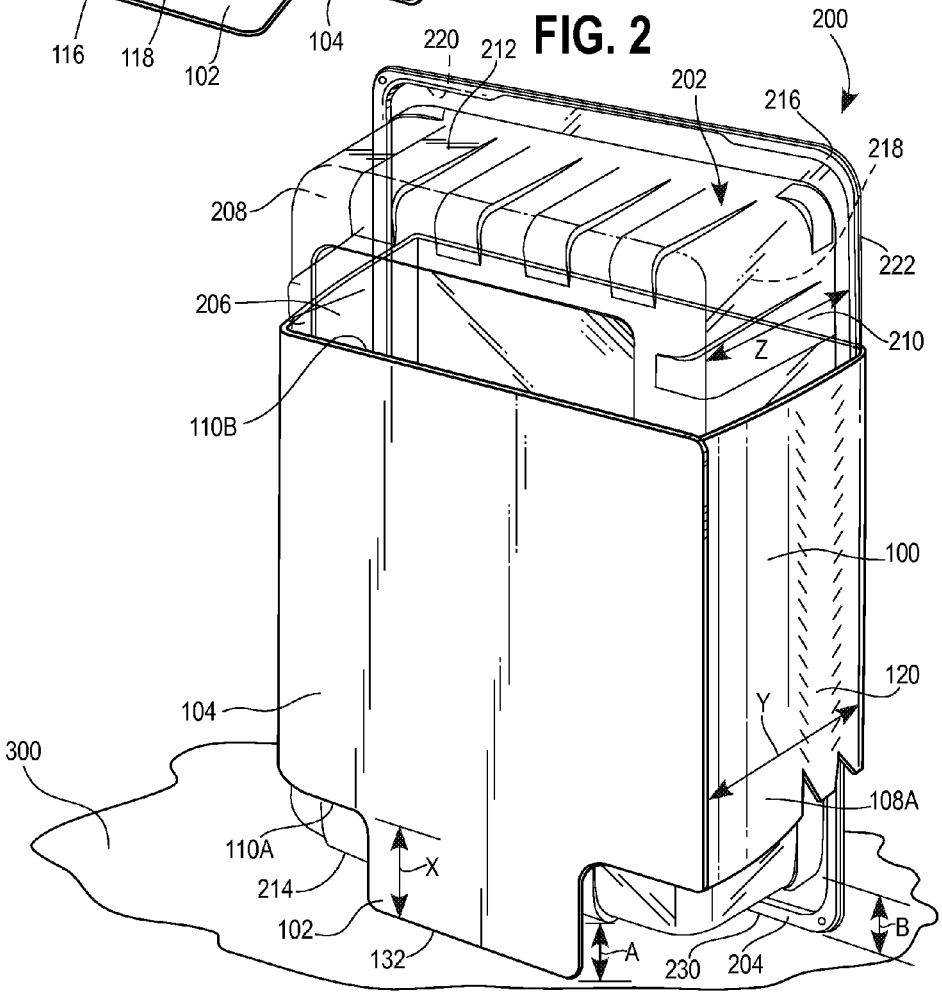
FIG. 2 is a perspective view of a package contained in a wraparound sleeve illustrated in an upright position.

A preferred embodiment of a wraparound elongate sleeve 100 with a stand-up support tab 102 is shown in FIGS. 1-2. The sleeve 100 includes a tab or extension member 102 that extends from an exposed edge 110A of the elongate sleeve 100 transverse to the sleeve wrapping direction D to cooperate with a front flange portion 204 of a container 202 retained therein to stand the food package upright.

Referring to FIG. 1, the sleeve 100 has at least four panel portions 104, 106, 108A and 108B that can define an interior portion for receiving a food container or package 202. The sleeve 100 can have a front panel portion 106 opposite the back panel portion 104 with a pair of side panel portions 108A and 108B extending therebetween. One of the panel portions 108A can overlap an interior surface 116 of an adjacent panel portion 104, where the overlapping portion 118 of panel portion 108A is secured to the adjacent panel portion 104 to provide interconnected panel portions to maintain the sleeve 100 in an assembled configuration. The overlapping portion 118 of panel portion 108A can be secured to the sleeve 100 by an adhesive or any other appropriate manner typical in the art.

The direction that the unconnected sleeve panel portions are wrapped to provide an interconnected sleeve can be defined as a predetermined wrapping direction. For instance, in FIG. 1, the predetermined wrapping direction is indicated by the arrow D, such that the wrapping direction is in a direction that will bring the overlapping panel portion 118 in contact with the interior surface 116 of the adjacent panel portion 104. Alternatively, the overlapping panel portion 118 can also be adhered to an exterior surface of the adjacent panel portion. Any panel portion can overlap any other panel portion as long as it results in interconnected panel portions forming a sleeve 100. The interconnected panel portions form a partially enclosed interior that is open on two ends of the sleeve 100 for receiving a tray or container 202 therein, to be discussed in more detail below.

Each of the four panel portions 104, 106, 108A and 108B is formed with corresponding corners 114A-D positioned between adjacent panels when in the assembled configuration as seen in FIG. 1. The corners are formed at the intersection of two adjacent panel portions, where the adjacent panel portions share a common edge. For instance, adjacent panel portions 106 and 108A include corresponding corner 114C. Similarly, any two adjacent panel portions include a corresponding corner along the intersection of the adjacent panel portions. In the case of adjacent panel portions that are adhered together, such as with 108A and 104, the common edge or corner can be the edge defined by the intersection of three areas; the two panel portions 108A, 104 and overlapping segment 118. The corner 114A is defined by the intersection of the side panel portion 108A with bottom panel portion 104 and with the fold area between side panel portion 108A and its overlapping panel portion 118.

A pair of exposed edge portions 110A-B, 111A-B, 112A-B, and 113A-B are provided at each panel portion 104, 106, 108A, and 108B, respectively, and extending transverse to and between the corners at either exposed side of its respective panel portion. The exposed edge portions 110A-B, 111A-B, 112A-B, and 113A-B of the sleeve 100 generally extend in the predetermined wrapping direction D, such that the exposed edge portions are generally parallel to the wrapping direction D. For example, back panel portion 104 has corresponding corners 114A and 114B, between which the pair of exposed edge portions 110A and 110E extend transversely. When the sleeve 100 is placed in an upright position, where the upright position can be defined by the extension member 102 resting upon its lower edge 132 generally normal to a support surface 300, then the panel portions can be defined by an upper and a lower exposed edge portion. In the case of the back panel portion 104, when in an upright position, as shown in FIG. 2, the back panel portion 104 can have a lower exposed edge portion 110A and an upper exposed edge portion 110B. The other panel portions can have similar orientations.

The tab or extension member 102 extends from an exposed edge portion and, in one aspect, extends transversely from a lower exposed edge portion and spaced from the adjacent corners. In another aspect, the tab 102 extends transversely from the exposed edge portion 110A of the back panel portion 104 and is spaced from adjacent corners 114A and 114B. The tab 102 extends transverse to the predetermined wrapping direction D, as previously defined, along the exposed edge portion 110A, and not as an extension or overlapping section of one of the panel portions. Thus, the tab 102 is present in the sleeve or panel portion at a predetermined height whether the sleeve is assembled or not. Upon assembling the sleeve 100, the panel portions are wrapped in the wrapping direction D to interconnect the panel portions without having to form the tab 102 since it is already formed along the exposed edge portion 110A.

In one aspect, the tab 102 can be centrally located along the exposed edge portion it extends from. As shown in FIG. 1, the tab 102 can be generally centrally located upon the lower exposed edge portion 110A of the back panel portion 104. Alternatively, the tab 102 can extend at any location along the exposed edge. The tab 102 can extend along all or part of the exposed edge portion.

The tab 102 can extend from the exposed edge portion a predetermined distance X, as shown in FIG. 2, in a direction transverse to the exposed edge portion 110A. The distance X of the tab 102 can represent a width or length of the tab 102 extending beyond the exposed edge portion 110A. An adjacent side panel portion 108A or 108B can have a height Y to which the side panel portions extend between the front panel portion 106 and the back panel portion 104 that is greater than the distance X of the tab 102. In one aspect, the distance X of the tab 102 can be less than half of the width Y of the adjacent side edge panel 108A or 108B such that if the tab 102 were folded inward along the exposed edge portion 110A toward the opposite exposed edge portion 111A, the bottom edge portion 132 of the tab 102 would not reach the opposite exposed edge portion 111A.

The sleeve 100 may optionally contain a frangible portion 120 that extends along one or more of the panel portions for separating the sleeve 100 between its interconnected panel portions. The frangible portion 120 can extend along the sleeve 100 transverse to the predetermined wrapping direction D. The frangible portion 120 can be removed to separate sections of the sleeve 100 to remove the sleeve from around its respective container 202. The frangible portion 120 can include a grasping member 134 that can be grasped and pulled in a direction transverse to the predetermined wrapping direction D to begin tearing or separating the frangible portion 120 from the adjacent sections of the sleeve 100 on either side of the frangible portion 120.

The frangible portion 120 can extend from one exposed edge portion 112A to an opposite exposed edge portion 112B. In one aspect, the frangible portion 120 can be spaced from an adjacent corner 114A such that upon tearing the frangible portion 120 the corner 114A will remain intact. In another aspect, the frangible portion 120 can include all or part of the corner 114A such that upon tearing the frangible portion 120 at least a portion of the corner 114A will also tear. The frangible portion 120 can be positioned on any one or more of the panel portions. In another aspect, the frangible portion 120 can be positioned on either one of the side panel portions 108A or 108B. The frangible portion can comprise any typical removable feature commonly used, such as a score line, a perforation, a tear strip, and the like.

Referring to FIG. 2, a food package 200 is illustrated showing a container 202 having the sleeve 100 wrapped therearound. The container 202 includes a bottom wall 206, a pair of side walls 208 and 210 upstanding from the bottom wall 206 and a pair of end walls 212 and 214 upstanding from the bottom wall 206. Together the walls form an interior 218 of the container 202 for receiving foodstuffs therein. Opposite the bottom wall 206 is an opening 220 in the container 202 through which the foodstuffs are placed to be stored in the interior 218 of the container 202 and later removed. An upper flange 216 can also extend about the opening of the container 202, where the upper flange 216 is positioned at an upper end of the pair of side walls 208, 210 and the pair of end walls 212, 214 opposite the bottom wall 206.

The opening 220 of the container 202 can be covered by a film 222, which closes the container 202 and prevents access to the opening 220 until the film 222 is removed. Optionally, the container 202 can have a lid or other closure member placed over the opening 220 instead of or in addition to the film 222 that covers the opening 220.

The sleeve 100 can be assembled prior to inserting the container 202 therein or the sleeve 100 can be assembled around the container 202, such that the panel portions of the sleeve 100 are wrapped around the container 202 and interconnected about the container 202 and, in one aspect, the panel portions can be connected or adhered to the container 202. In the aspect where the sleeve 100 is pre-assembled, the container 202 can be inserted into the sleeve 100 such that a front panel portion 106 of the sleeve 100 extends across the opening 220 of the container 202 and a back panel portion 104 extends across the bottom wall 206 of the container 202. The side panel portions 108A, 108B can substantially extend across the side walls 208, 210 of the container 202. The pair of end walls 212, 214 are not covered by any panel portion of the sleeve 100. In general, the sleeve 100 is placed around the container 202 such that there are upper portions and lower portions of the side walls 208, 210 and the bottom wall 206 that are exposed beyond the sleeve 100 while the end walls 212, 214 are completely exposed beyond the sleeve 100. The panel portions of the sleeve are sized to be substantially similar in width to the wall portions of the container 202 that they cover, where a width of the container is parallel to the wrapping direction. In particular, the width of the panel portions of the sleeve are sized to have widths that provide a relatively tight fit to contain the container 202 therein without the container 202 easily falling out of the sleeve 100. The sleeve 100 does not cover the container 202 completely along a length of the container, where a length of the container 202 is transverse to the wrapping direction.

In another aspect where the elongate sleeve 100 is wrapped and assembled around the container 202, the sleeve 100 is wrapped in the predetermined wrapping direction D, such that the sleeve 100 covers a portion of the opening 220, extending transversely across the flange 216, and further covers a portion of the opposing pair of side walls 208 and 210 as well as a portion of the bottom wall 206. In this aspect, the wrapped sleeve 100 does not extend across or along the pair of end walls 212, 214 such that the pair of end walls 212, 214 are completely exposed from the sleeve 100 and extend beyond the exposed edge portions of the sleeve 100. Alternatively, the elongate sleeve 100 can also be wrapped or placed around the container 202 in any other orientation, as long as either one pair of the side walls or end walls is completely exposed from the sleeve 100.

Optionally, whether the sleeve 100 is preformed or formed around the container 202, the sleeve 100 can be adhesively secured to the container 202. The sleeve 100 can be adhered to a portion of the food container 202 to further ensure that the sleeve 100 cannot slide off of the container 202 or be removed unintentionally. Thus, in one aspect, an underside or interior surface of the sleeve 100 can be glued or adhered to a portion of the container 202, such as a small section of the bottom wall 206. Furthermore, since the sleeve 100 does not completely cover the container 202, the interior 218 of the container 202 can be viewed by a consumer where the container 202 is transparent or translucent. This allows a consumer to at least partially view the contents of the container 202 while the sleeve 100 is in place around the container 202.

The tab 102 extending transverse to the predetermined wrapping direction D can be sized to support the container 202 on a support surface 300 in an upright position, where the upright position is such that the pair of side walls 208, 210 extend generally normal to the support surface 300. The tab 102 can cooperate with a part of the container 202 opposite the tab 102 and extending beyond the sleeve 100 to stand the container 202 upright. In one aspect, the tab 102 can cooperate with a front flange portion 204, opposite the tab 102, that extends beyond one of the end walls that is exposed from the sleeve 100, the tab 102 being adjacent to and extending beyond the same end wall to support the container 202 in the upright position. In another aspect, the tab 102 extends beyond end wall 214 and cooperates with the front flange portion 204 that extends beyond end wall 214 and is exposed from the sleeve 100, the front flange portion 204 resting upon lower edge 230.

The tab 102 can extend beyond the end wall 214 a first distance A and the front flange portion 204 can extend beyond the end wall 214 a second distance B, such that the second distance B is greater than or equal to the first distance A. This provides for the food package to be displayed in either a vertical or inclined position when placed in the upright position. The inclined position would result when the front flange portion 204 extends at a greater distance B than the distance A that the tab 102 extends beyond the end wall 214. This provides for the package 200 to tilt or lean backwards, such that the front surface of the package, as defined by the top film 222 and front panel portion 106 of the sleeve, remains visible from above the package 200. The inclined position can be angled at less than 90 degrees from the vertical position, or from a front viewing position, where the angle is measured between the support surface 300 and the front surface of the package.

In one preference, the distance A that the tab 102 extends beyond the end wall 214 is approximately the same as the distance B that the front flange portion 204 extends beyond the same end wall 214. This allows the package 200 to stand upright in a generally vertical orientation.

As previously mentioned, the tab 102 extends from the exposed edge portion 110A a distance X beyond the sleeve 100. The upstanding side walls 208, 210 and the upstanding end walls 212, 214 have a height Z to which the walls extend up from the bottom wall 206. The predetermined distance X that the tab 102 extends from one of the edge portions 110A of the sleeve 100 is less than the height Z of the adjacent one of the end walls 212, 214 or side walls 208, 210 of the container 202.

The tab or extension 102 may optionally contain a perforated portion to allow movement of the tab 102 or to allow the tab 102 to be separated from the rest of the sleeve 100 and be torn off. The perforated portion can be provided at the interface of the exposed edge portion 110A and the tab 102. The perforated portion can be a score line, a perforation or other appropriate bendable or frangible area that allows for easy separation of the tab 102 from the sleeve 100. The perforated portion should also be sturdy enough to allow the tab 102 to stand upon its edge 132 and to cooperate with the flange portion 204 of the container 202 to allow the package 200 to stand upright while supported on the tab 102, yet also provide for the tab 102 to be removable with little effort. Thus, the tab 102 can contain a perforated portion yet still provide strength and durability to support the package 200. Additionally, the tab 102 can contain graphics or text that convey a message or offer, such as a coupon or rebate, which would allow the tab 102 to be removed from the sleeve 100 after use of the package 200.

The container 202 can be made of any typical container material compatible with packaging foodstuffs. The container 202 can also be rigid or semi-rigid. The terms "rigid"

and "semi-rigid" are used herein to indicate that the structures made of these films have the ability to generally retain their respective shapes during normal handling. Additionally, the container 202 can preferably be made from a transparent or translucent material such that the contents therein can be viewed by the consumer when looking through the container 202.

The flexible film 222 that seals the opening 220 of the container 202 can comprise an air impermeable flexible film. The flexible film 222 can preferably comprise an oxygen barrier film material, such that the food items sealed within the interior 218 of the container 202 are hermetically sealed therein. The flexible film 222 can also comprise a transparent film to permit viewing therethrough of the items within the interior 218 of the container 202. The flexible film 222 can be heat sealed to the container 202 peripheral flange 216 or any similar method of adhering the flexible film 222 to the flange 216 of the container 202 may be used.

The sleeve 100 can comprise a material that is durable and strong yet also foldable to assemble the sleeve 100 around the container 202. The sleeve 100 material of construction can comprise paperboard, cardboard, flexible plastic film, semi-rigid plastic film, rigid plastic film, paper and any combinations thereof.

The sleeve can have any shape that would allow it to be wrapped around or receive a container within its interior area. Preferably, the shape of the sleeve 100 will compliment or be similar to the general shape of the container 202 that the sleeve 100 is wrapped around. Thus, if the container 202 is generally rectangular then the sleeve 100 wrapped around the container 202 can also be generally rectangular. In one aspect, the sleeve 100 can be generally rectangular, however, some of the exposed edges can contain decorative cuts or angled edges to provide for an attractive display of the sleeve 100 and to allow increased viewing area of the contents of the container 202. In another aspect, the sleeve 100 can have writing or other graphics along the outer surface of the sleeve.

The sleeve 100 can have any size that is appropriate for wrapping around or receiving a container 202 therein. In general, the overall dimensions of the sleeve 100 will not be larger than the container 202 it is wrapped around such that portions of the container 202, such as the end walls, can be exposed and visible beyond the sleeve 100. In one aspect, the sleeve can be generally rectangular with dimensions of side panel portions having a length of about 4.5 inches and a width of about 2.75 inches, the back panel portion having a length of about 4.5 inches (not including the extension of the tab) and a width of about 3.875 inches. The front panel portion can have similar dimensions to the back panel portion or it can be larger or smaller depending upon whether the container stored therein has a taper. In one aspect, where the container is tapered such that the bottom wall is narrower than the top opening area of the container, the front panel portion of the sleeve can have dimensions that are greater than the back panel portion, such as a length of about 5.25 inches and a width that can vary from about 3.625 to about 4.5 inches, depending on the design or angled cut employed. However, any other appropriate dimensions can be provided.

The tab 102 can also have any appropriate length to stand the package either vertically upright or inclined at an angle less than 90 degrees. The length of the tab 102 can also depend upon the placement of the sleeve 100 upon the container 202. Where the sleeve is placed higher up on the container 202, i.e., closer to the upper end wall 212, the tab 102 will need to be longer to extend beyond the lower end wall 214. Where the sleeve 100 is placed lower on the container 202, the height of the tab 102 can be shorter. In one aspect, where the sleeve is placed closer to a lower end of the container, i.e., closer to lower end wall 214, than an upper end, the tab 102 can have a height X of about 1 inch, or any other appropriate height.

The sleeve 100 wraps around the container 202 used to store foodstuffs such that the completed package 200 can be used to store and display the foodstuffs until purchased by the consumer. Any foods can be stored within the container 202 such as meats, cheeses, snack foods, sandwiches, drinks, desserts, and any other foodstuff commonly packaged in a container for later consumption by a consumer. In one aspect, the food package 200 can contain foods that can make up a meal or ready to eat foods, such as a sandwich, snack, dessert and a drink. The container can also include eating utensils and any other type of non-food item that would be relevant to a ready to eat food container. The food package 200 is not limited to the combinations disclosed herein and any number of food and non-food item combinations may be provided within the container 202.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A food package comprising:

a container having a bottom wall, a pair of upstanding side walls, and a pair of upstanding end walls;

an opening in the container opposite the bottom wall through which foodstuffs are received therein;

an upper flange of the side and end walls extending about the opening;

an elongate sleeve that is wrapped around the container in a predetermined wrapping direction extending transversely across the flange, opposing pair of side walls, and the bottom wall;

an extension member of the sleeve extending transverse to the predetermined wrapping direction, the extension member sized to support the container on a support surface in an upright position along an edge of the extension member that extends in the predetermined wrapping direction and wherein the pair of side walls extend generally normal to the support surface; and wherein the flange includes a flange portion extending along one of the end walls that is exposed from the wrapped sleeve and the extension projects beyond the one end wall to cooperate with the flange portion to support the container in the upright position.

2. A food package comprising:

a container having a bottom wall, a pair of upstanding side walls, and a pair of upstanding end walls;

an opening in the container opposite the bottom wall through which foodstuffs are received therein;

an upper flange of the side and end walls extending about the opening;

an elongate sleeve that is wrapped around the container in a predetermined wrapping direction extending transversely across the flange, opposing pair of side walls, and the bottom wall, and wherein the wrapped sleeve does not extend across or along the end walls so that the pair of end walls of the container are completely exposed from the sleeve;

an extension member of the sleeve extending transverse to the predetermined wrapping direction, the extension member sized to support the container on a support surface in an upright position along an edge of the extension member that extends in the predetermined wrapping direction and wherein the pair of side walls extend generally normal to the support surface; and wherein the extension extends beyond the one end wall a first distance and the flange portion extends beyond the one end wall a second distance greater than or equal to the first distance so that the upright position of the container is either inclined or vertical, respectively.

3. A food package comprising:

a container having a bottom wall, a pair of upstanding side walls, and a pair of upstanding end walls;

an opening in the container opposite the bottom wall through which foodstuffs are received therein;

an upper flange of the side and end walls extending about the opening;

an elongate sleeve that is wrapped around the container in a predetermined wrapping direction extending transversely across the flange, opposing pair of side walls, and the bottom wall, and wherein the elongate sleeve is adhesively secured to the container;

an extension member of the sleeve extending transverse to the predetermined wrapping direction, the extension member sized to support the container on a support surface in an upright position along an edge of the extension member that extends in the predetermined wrapping direction and wherein the pair of side walls extend generally normal to the support surface; and wherein the sleeve is secured to the container so that there are upper and lower portions of the side and bottom walls exposed beyond the sleeve.

* * * * *